US012635803B2

(12) United States Patent
Feiler, IV

(10) Patent No.: US 12,635,803 B2
(45) Date of Patent: May 26, 2026

(54) CONVERTIBLE FURNITURE ARRANGEMENT

(71) Applicant: Patrick Industries, Inc., Elkhart, IN (US)

(72) Inventor: Laurence George Feiler, IV, Nappanee, IN (US)

(73) Assignee: Patrick Industries, Inc., Elkhart, IN (US)

( * ) Notice: Subject to any disclaimer, the term of this patent is extended or adjusted under 35 U.S.C. 154(b) by 33 days.

(21) Appl. No.: 18/927,150

(22) Filed: Oct. 25, 2024

(65) Prior Publication Data

US 2026/0114628 A1 Apr. 30, 2026

Related U.S. Application Data

(60) Provisional application No. 63/592,745, filed on Oct. 24, 2023.

(51) Int. Cl.

| | |
|---|---|
| ***A47C 17/16*** | (2006.01) |
| ***A47C 17/165*** | (2006.01) |
| ***A47C 17/62*** | (2006.01) |

(52) U.S. Cl.

CPC ..... *A47C 17/161* (2013.01); *A47C 17/165* (2013.01); *A47C 17/62* (2013.01)

(58) Field of Classification Search

CPC ..... A47C 17/161; A47C 17/165; A47C 17/62; A47C 17/20; A47C 17/86; A47C 17/2076; A47C 19/22; A47C 20/028; A47C 7/68; A47C 7/70

USPC ..... 5/53.2

See application file for complete search history.

(56) References Cited

U.S. PATENT DOCUMENTS

| | | | |
|---|---|---|---|
| 1,290,152 | A | 1/1919 | Fichtenbaum |
| 1,519,674 | A | 12/1924 | Dyke |
| 1,743,216 | A | 1/1930 | Honsinger |
| 1,747,150 | A | 2/1930 | Fox |
| 1,764,874 | A | 6/1930 | Hultgren |
| 1,764,875 | A | 6/1930 | Hultgren |
| 1,775,672 | A | 9/1930 | Duvall |
| 1,806,259 | A | 5/1931 | Hultgren |

(Continued)

FOREIGN PATENT DOCUMENTS

| | | | |
|---|---|---|---|
| CN | 305387554 | S | 10/2019 |
| CN | 305488936 | S | 12/2019 |

(Continued)

*Primary Examiner* — Aaron R Eastman

(74) *Attorney, Agent, or Firm* — Price Heneveld LLP

(57) ABSTRACT

A convertible furniture arrangement includes a pair of arm assemblies secured to a back frame, a support frame, a seat member movable between a first position where the seat member is configured to support a seated user thereon and a second position where the seat member is configured to support the user in a prone position, a link member coupled to the support frame and the seat member and positioned vertically below the seat member when the seat member is in the first position and is configured to support the user that is in the prone position when the seat member is in the second position, a support surface movable between a back rest position and a table position when the seat member is in the first position, and a pair of L-shaped connection members that support the support surface between the back rest position and the table position.

25 Claims, 9 Drawing Sheets

(56) References Cited

U.S. PATENT DOCUMENTS

| | | | |
|---|---|---|---|
| 1,809,812 | A | 6/1931 | Fox |
| 1,852,185 | A | 4/1932 | Moeller |
| 1,854,841 | A | 4/1932 | Hultgren |
| 2,851,698 | A | 9/1958 | Barabas et al. |
| 3,317,930 | A | 5/1967 | Wiberg |
| 3,389,409 | A | 6/1968 | Rogers, Jr. |
| 3,456,268 | A | 7/1969 | Rogers, Jr. |
| 3,906,558 | A | 9/1975 | Alembik |
| 4,212,090 | A | 7/1980 | Ehrlich |
| 4,590,630 | A | 5/1986 | Barabas |
| 4,672,696 | A | 6/1987 | Horenkamp |
| 4,860,393 | A | 8/1989 | Schefthaler |
| 4,866,795 | A | 9/1989 | Dahlqvist |
| 4,922,561 | A | 5/1990 | Williams |
| 4,985,945 | A | 1/1991 | Robinson |
| 5,722,101 | A | 3/1998 | Grigoriev |
| 5,904,401 | A | 5/1999 | Alberda et al. |
| 6,341,392 | B1 | 1/2002 | Auvo |
| 6,904,628 | B2 | 6/2005 | Murphy et al. |
| 7,827,629 | B1 | 11/2010 | Guillot |
| 8,011,034 | B2 | 9/2011 | Hoffman et al. |
| 8,438,676 | B2 | 5/2013 | Murphy |
| 8,893,323 | B2 | 11/2014 | Garland |
| 8,997,273 | B2 | 4/2015 | Murphy et al. |
| 9,144,319 | B2 | 9/2015 | Murphy et al. |
| 9,173,502 | B2 | 11/2015 | Smith et al. |
| 9,414,688 | B2 | 8/2016 | Gardner |
| 9,420,894 | B2 | 8/2016 | Thurow |
| 9,622,587 | B2 | 4/2017 | Murphy |
| 9,642,468 | B2 | 5/2017 | Murphy et al. |
| 9,854,916 | B2 | 1/2018 | Murphy |
| 9,895,002 | B1 | 2/2018 | Cooke et al. |
| 10,226,131 | B2 | 3/2019 | Thurow |
| 10,556,524 | B1 | 2/2020 | Slater |
| 11,234,532 | B1 * | 2/2022 | Ruby ..... A47C 17/20 |
| 12,075,913 | B2 | 9/2024 | Williams |
| 2003/0070225 | A1 | 4/2003 | Murphy et al. |
| 2016/0051057 | A1 | 2/2016 | Murphy |
| 2018/0064258 | A1 | 3/2018 | Murphy |
| 2018/0116410 | A1 | 5/2018 | Ritter et al. |
| 2019/0110604 | A1 | 4/2019 | Garland |
| 2024/0341488 | A1 | 10/2024 | Williams |

FOREIGN PATENT DOCUMENTS

| | | | |
|---|---|---|---|
| CN | 305513406 | S | 12/2019 |
| DE | 19521139 | A1 | 1/1996 |
| EP | 1464256 | A1 | 10/2004 |
| EP | 2850973 | A1 | 3/2015 |
| EP | 2875754 | A1 | 5/2015 |
| PL | 121965 | U1 | 10/2014 |

* cited by examiner

CONVERTIBLE FURNITURE ARRANGEMENT

CROSS-REFERENCE TO RELATED APPLICATIONS

This application claims benefit to U.S. Provisional Patent Application No. 63/592,745, filed Oct. 24, 2023, entitled "CONVERTIBLE FURNITURE ARRANGEMENT," the entire disclosure of which is incorporated herein by reference.

BACKGROUND OF THE INVENTION

The embodiments as shown and described herein relate to a convertible furniture arrangement, and in particular to a furniture arrangement that may be converted between a seating configuration, a bed configuration, and at least one table configuration.

SUMMARY OF THE INVENTION

One embodiment as shown and described herein includes a convertible furniture arrangement that includes a back frame, a pair of arm assemblies fixedly secured to the back frame, a support frame positioned forward of the back frame and between the pair of arm assemblies, a seat member movable between a first position where the seat member is positioned over the support frame and configured to support a seated user thereon and a second position where the seat member is extended away from the support frame and configured to support the user that is in a prone position, a link member operably coupled to the support frame and operably coupled to the seat member, where the link member is positioned vertically below the seat member when the seat member is in the first position and the link member is positioned horizontally between the support frame and the seat member and is configured to support the user that is in the prone position when the seat member is in the second position. The convertible furniture arrangement further includes a support surface movable between a back rest position where the support surface is located proximate the back frame and substantially vertically oriented and a table position where the support surface is located forward of the seat member when the seat member is in the first position and where the support surface is substantially horizontally oriented to be utilized as a table surface, and a pair of L-shaped connection members each having a first end coupled to the support frame and a second end coupled to the support surface, where the connection members support the support surface between the back rest position and the table position.

Another embodiment of the convertible furniture arrangement as shown and described herein may further or alternatively include support frame, a back frame coupled with the support frame, at least one connection member pivotally coupled with the support frame at a first side of the support frame, wherein the connection member is configured to move between a retracted position proximate the base frame and an extended position in front of the base frame, and a support surface coupled with the at least one connection member, wherein the support surface is configured to move between a back rest position where the support surface is substantially vertically oriented and where the support surface is located between the back member and a user in a seated position, and a table position where the support surface is substantially horizontally oriented and is configured to be supported by the at least one connection member when the connection member is in the extended position. The convertible furniture arrangement may also include a link member pivotally coupled with the support frame, wherein the link member is configured to move between a first position and a second position, and a seat member coupled with the link member, wherein the seat member is configured to move between a first position where the seat member is located above the link member and is configured to support the user in the seated position and a second position where the seat member is horizontally spaced from the support frame by the link member and is configured to support the user in a prone position.

Yet another embodiment as shown and described herein may further or alternatively include a furniture arrangement convertible between at least three configurations, the configurations including: a seating configuration that includes a support frame, a back frame coupled to the support frame, at least one connection member coupled to the support frame, a support surface coupled with the at least one connection member, the support surface substantially parallel with the back frame, a link member coupled with the support frame, and a seat member coupled with the link member, the link member and the seat member positioned above the support frame and configured to support a seated user; a bed configuration that includes the link member horizontally offset from the support frame and configured to support the user that is in a prone position, the seat member horizontally spaced from the support frame by the link member and configured to support the user in the prone position, and the support surface substantially parallel with the seat member and configured to support the user in the prone position; and a first table configuration that includes the seat member and the link member positioned above the support frame where the seat member is configured to support the seated user, the at least one connection member extending forward of the seat member, and the support surface positioned forward of the seat member and substantially horizontally oriented and configured to be supported above a floor surface by the at least one connection member.

Still yet another embodiment as shown and described herein may include a method of converting a furniture arrangement, the method comprising: pivoting a support surface between a back rest position that is generally vertical, a pivoted position that is generally horizontal at a first height and configured to support a user that is prone, and a table position that is generally horizontal at a second height higher than the first height and configured to support a dining element, pivoting a connection member along a first axis aligned with a first side of a support frame between a disposed position within the support frame and an erected position in front of the support frame, translating the connection member and the support surface coupled with the connection member toward and away from the support frame, pivoting a seat member between a first position disposed within the support frame and a second position in front of the support frame, and pivoting a link member between a seated position between the support frame and the seat member in the first position and a prone position co-planarly extending between the support surface in the pivoted position and the seat member in the second position.

Another embodiment as shown and described herein may further or alternatively include a convertible furniture arrangement comprising: a support frame, a connection member coupled with the support frame at a first side of the support frame, wherein the connection member pivots between a disposed position, an erected position in front of the support frame, and translates to a translated, erect position free of the support frame, a support surface coupled with the connection member, wherein the support surface pivots between a back rest position, a pivoted position between the support frame and a user, and a table position generally horizontal disposed above the connection member that is in at least one of the erected position and the translated, erected position, a link member coupled with the support frame at the first side of the support frame, wherein the link member pivots between a seated position between the support frame and a seat member and a prone position extending between the support surface and the seat member co-planarly, and the seat member coupled with the link member, wherein the seat member transforms between a first position above the link member and a second position in front of the link member.

These and other advantages of the embodiments as disclosed and described herein will further be understood and appreciated by those skilled in the art by reference to the following specification, claims and appended drawings.

DETAILED DESCRIPTION OF PREFERRED EMBODIMENT

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other characteristics relating to the embodiments disclosed herein are not to be considered as limiting, unless the claims expressly state otherwise.

Figure 3:
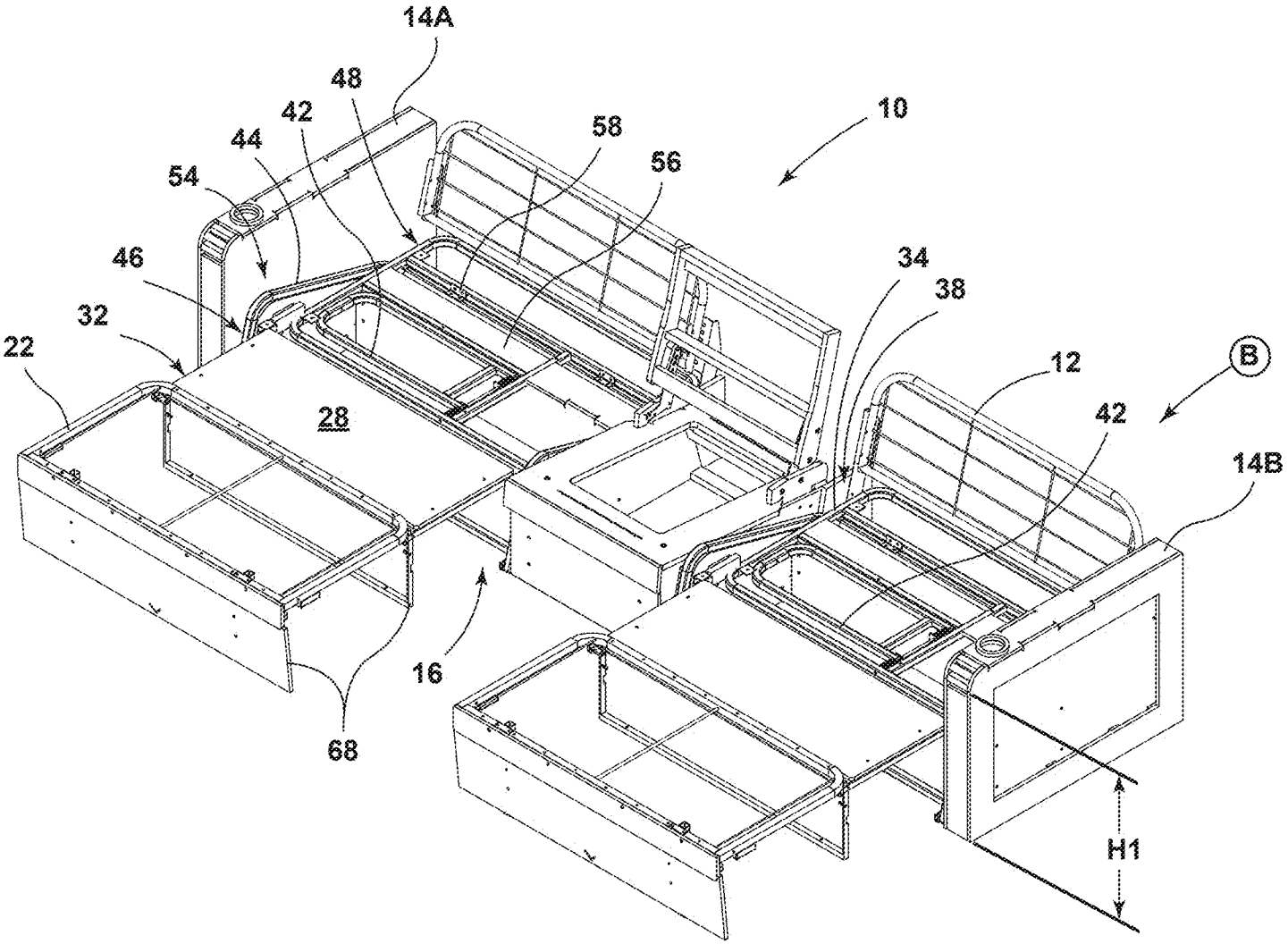
FIG. 3 is a top perspective view of the convertible furniture arrangement in a bed configuration or mode.
Figure 4:
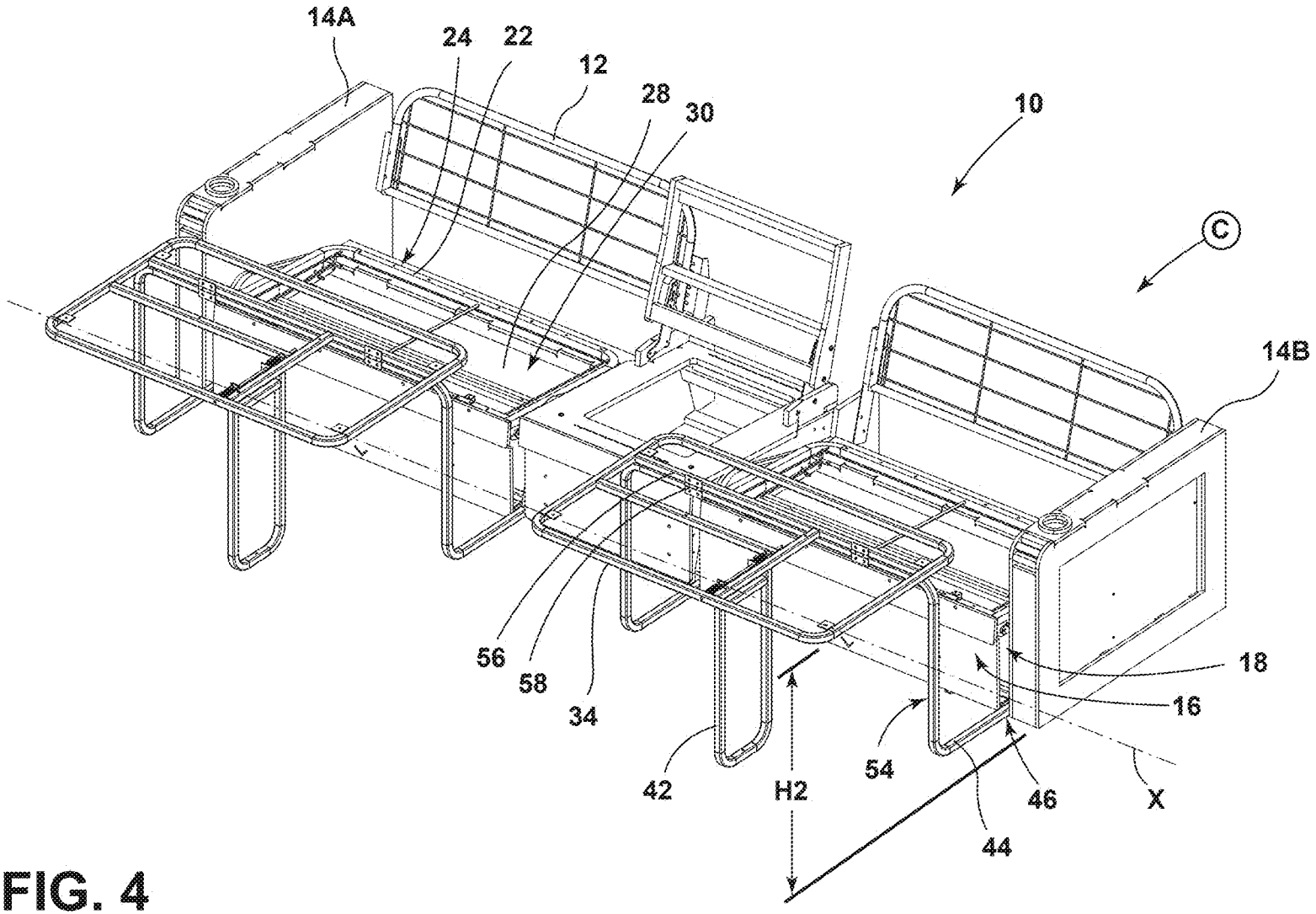
FIG. 4 is a top perspective view of the convertible furniture arrangement in a table dinette configuration or mode.

The reference numeral 10 (FIG. 1) generally designates a convertible furniture arrangement. In the illustrated example, the furniture arrangement 10 converts between four configurations or modes, including a seating configuration or mode A (FIG. 1), a bed configuration or mode B (FIG. 3), a first table or dinette configuration or mode C (FIG. 4), and a second table configuration or mode as described later herein.

Figure 1A:
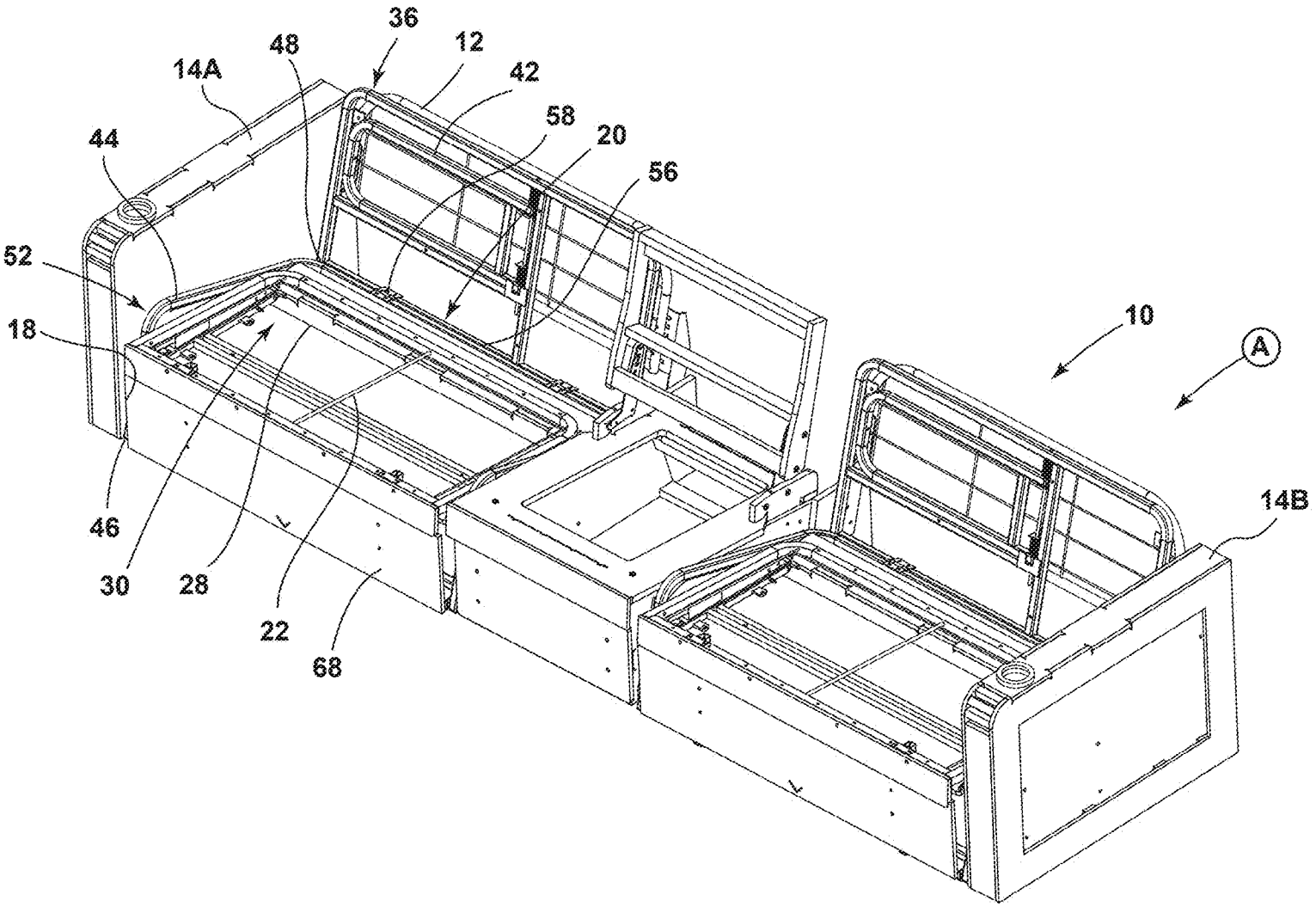
FIG. 1A is a top perspective view of an embodiment of a convertible furniture arrangement in a seating configuration or mode.
Figure 1B:
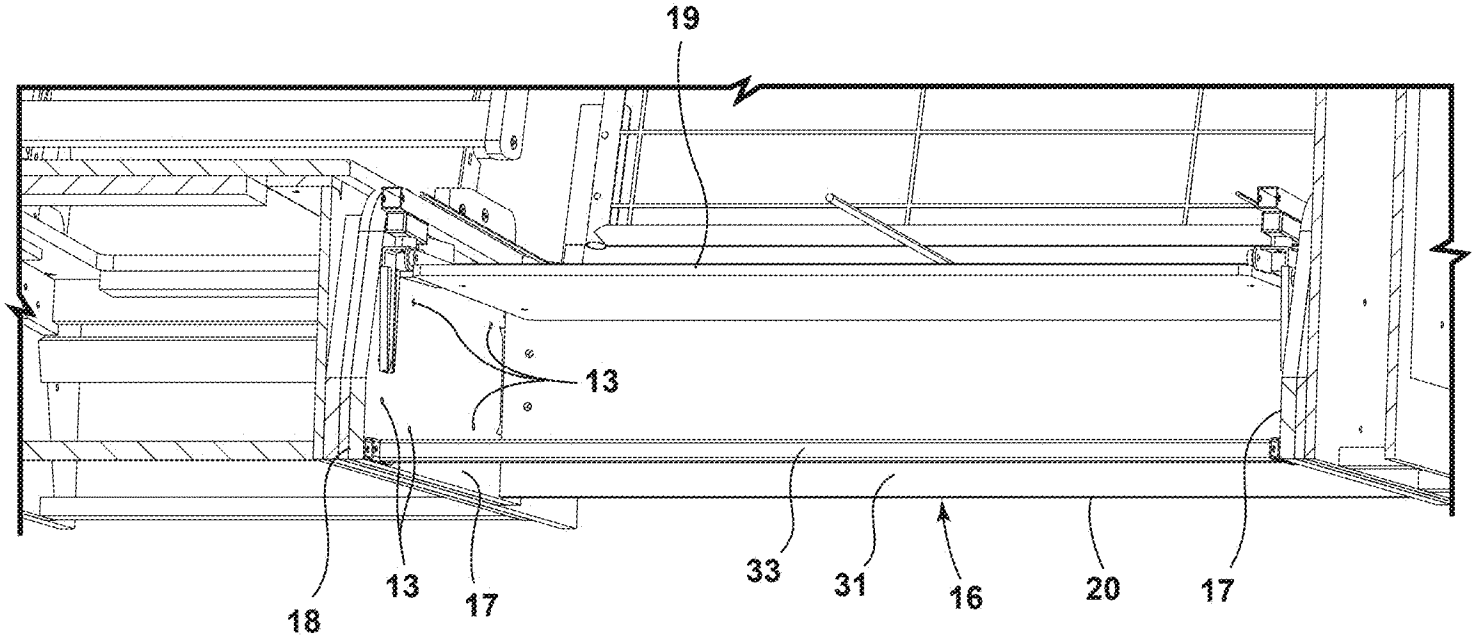
FIG. 1B is a cross sectional, partial bottom perspective view of the convertible seating arrangement, taken along the line IB-IB, FIG. 1A.

With reference to FIGS. 1A and 1B, the furniture arrangement 10 includes a support frame 16 coupled with a pair of arm assemblies 14A, 14B. The support frame 16 includes a pair of end frame members 17 that support an upper frame member 19, a rear frame member 31 extending between the end frame members 17, and a front frame member 33 extending between the end frame members 17, where the support frame defines a first or front side 18 and a second or rear side 20 opposite the first side 18. In the illustrated example, the end frame members 17 are detachably coupled to the arm assemblies 14A, 14B via a plurality of mechanical fasteners such as bolts 13.

Figure 8:
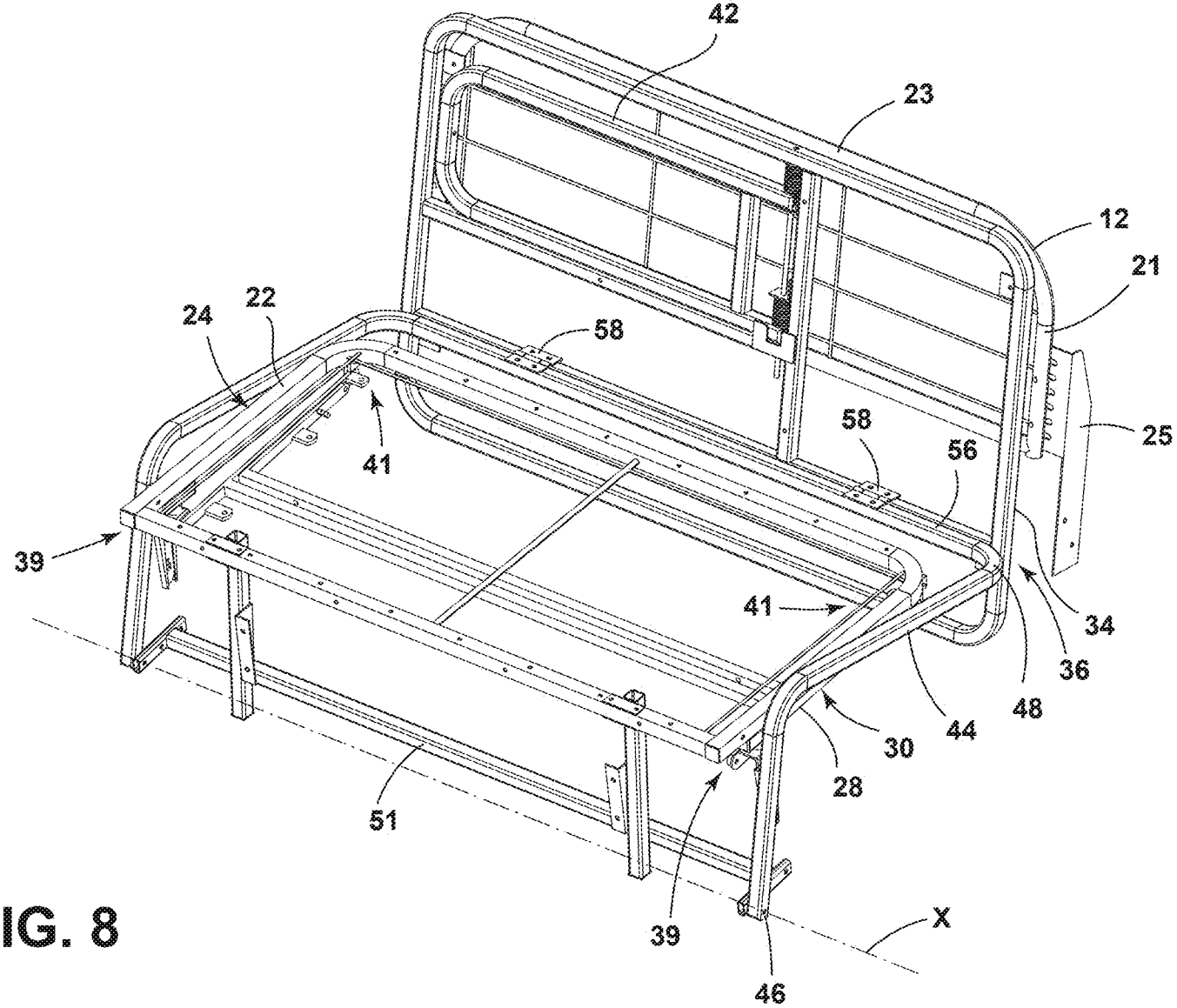
FIG. 8 is a top perspective view of an embodiment of a convertible furniture arrangement in a seating mode.

The furniture arrangement 10 (FIGS. 1 and 8) may further include a back frame 12 having vertical frame members 21 and horizontal frame members 23 extending between the horizontal frame members 21. In the illustrated example, the back frame 12 is fixedly coupled to the arm assemblies 14A, 14B via brackets 25. The back frame 12 may be fixed to the arm assemblies 14A, 14B such that the back frame 12 remains static relative to the arm assemblies 14A, 14B as the furniture arrangement 10 is moved between the various modes or configurations as described below.

Figure 5:
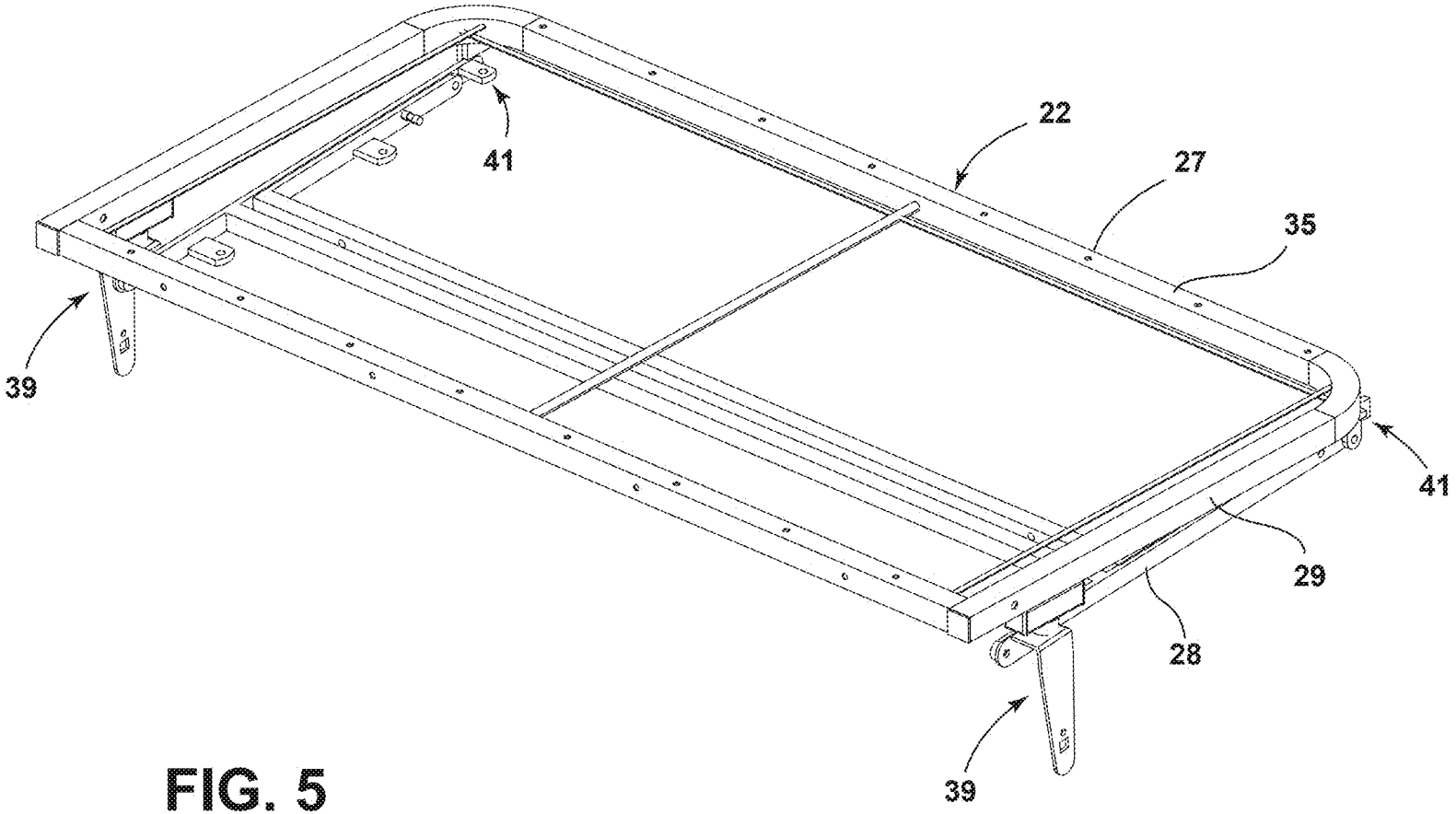
FIG. 5 is a top perspective view of a seat member and a link member.

The furniture arrangement 10 may further include a seat member 22 (FIGS. 1, 5, 8) that includes a seat frame assembly 27 including longitudinal frame member 29 and lateral frame member 35. Removable cushions (not shown) may be placed on and supported by the seat frame assembly 27 when the seat member is in a first or seated position and the furniture assembly is in the seating configuration as shown in FIG. 1.

The furniture arrangement 10 may further include a link member 28 (FIGS. 3, 5 and 8) pivotably coupled with the support frame 16 at the first side 18 of the support frame 16 via a pair of hinge arrangements 39. In certain embodiments, the link member 28 may also be coupled with at least one of the arm assemblies 14A, 14B. The link member 28 is further pivotably coupled with the seat member 22 via a pair of hinge arrangements 41. When in the seating mode A (FIG. 1), the link member 28 is in a first position 30 thereof where the link member 28 is positioned vertically beneath the seat member 22 and vertically above the support frame 16 such that the link member 28 is located between the seat member 22 and the support frame 16.

Figure 6:
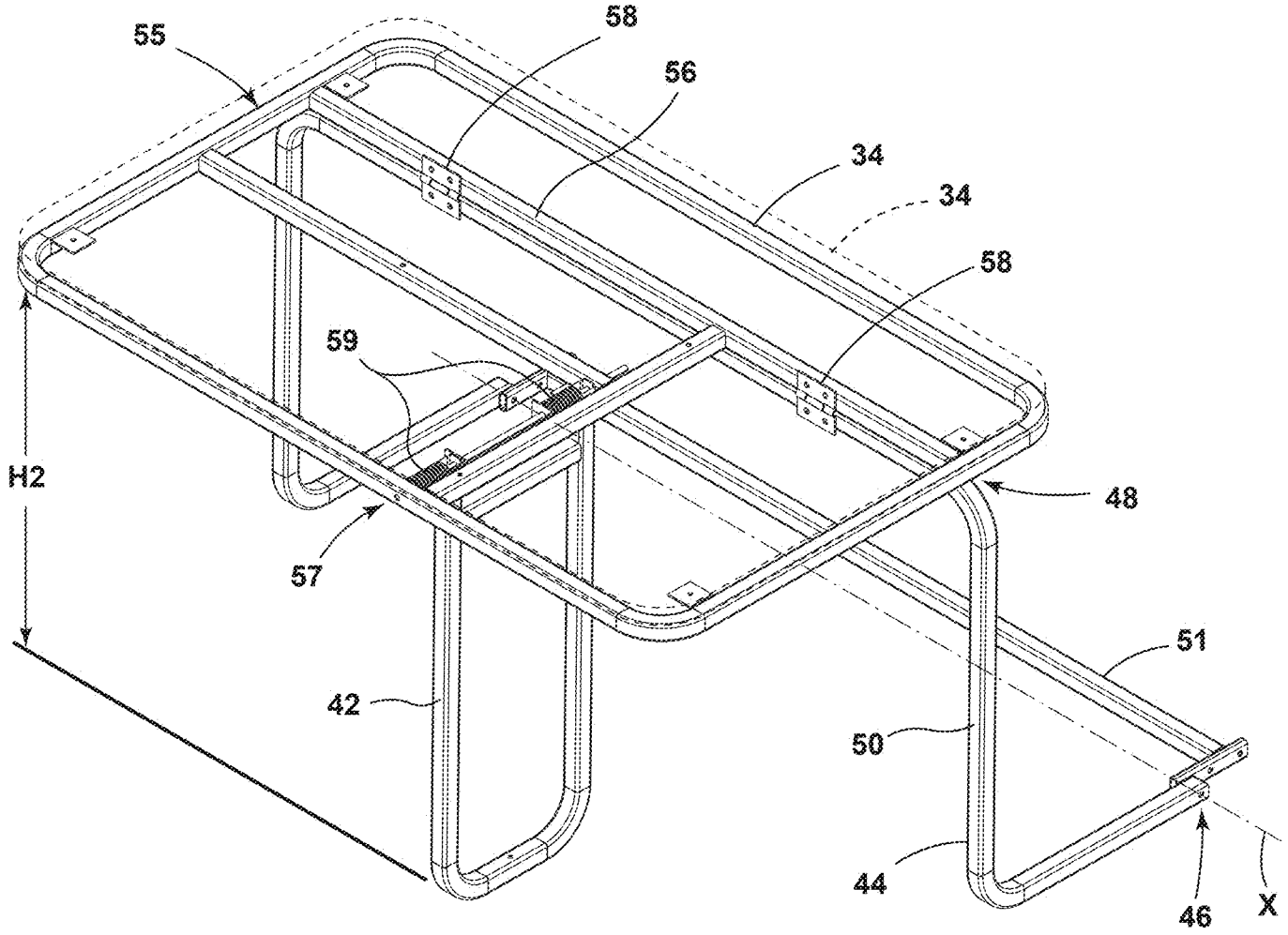
FIG. 6 is a top perspective view of a support arrangement including a support surface and a pair of connection members.
Figure 7:
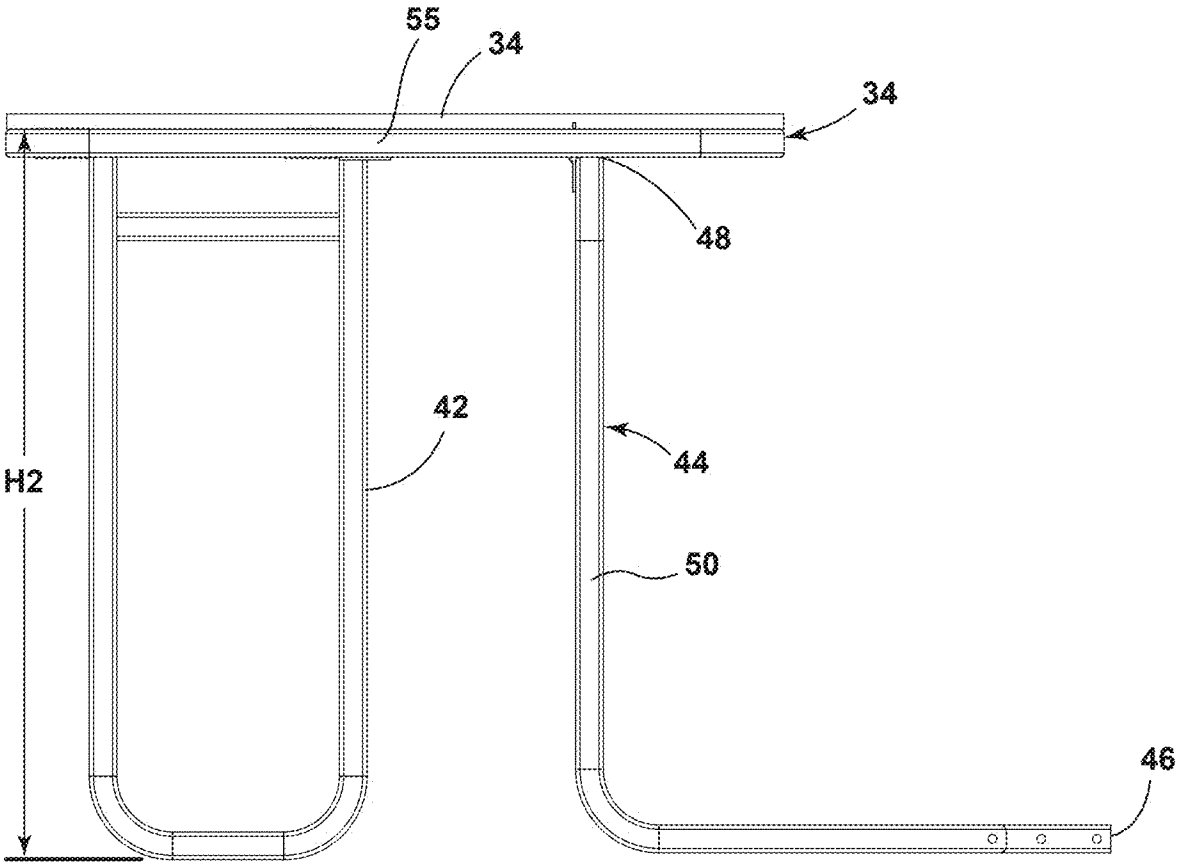
FIG. 7 is a side elevation view of the support surface and connection member.

The furniture arrangement 10 may include a connection arrangement 44 (FIGS. 3, 6 and 7) coupled with the support frame 16. The connection arrangement 44 may be coupled with at least one of the arm assemblies 14A, 14B. In the illustrated example, the connection arrangement 44 includes a pair of L-shaped lateral profile or connection members 50 each having a first end 46 and a second end 48 where the first ends are connected to one another via a cross member 56. The first end 46 of each of the connector members 50 are pivotably coupled to the first side 18 of the support frame 16 via a cross member 51. The connection arrangement 44 is shown in a retracted position in FIG. 1 and an extended position in FIG. 4, as further described below.

The furniture arrangement 10 may further include a support arrangement 53 (FIGS. 4, 6 and 7) that includes a rectangular support surface frame 55 and a support surface 34 coupled with the second end 48 of the connection arrangement 44. In the illustrated example, the support frame 35 is pivotably coupled with the cross bar 56 via a pair of hinges 58. In the seating configuration or mode A (FIG. 1), the support surface 34 is positioned proximate and substantially parallel with the back frame 12, where the support arrangement and is configured to support removable cushions (not shown) and the back of a seated user.

The support arrangement 53 may further include a drop-down leg 42 (FIGS. 1, 4 and 6) pivotably coupled with the support surface frame 55 via a pivot arrangement 57 where the leg 42 is configured to be selectively moved between a retracted position (FIG. 1) where the leg 42 is proximate and substantially parallel with the support surface 34 and an extend position (FIG. 4) where the leg 42 extends away from and is substantially perpendicular to the support surface 34 to support the support surface 34 and further described below. The leg 42 is biased from the extended position toward the retracted position via a pair of coil springs 59.

Figure 2:
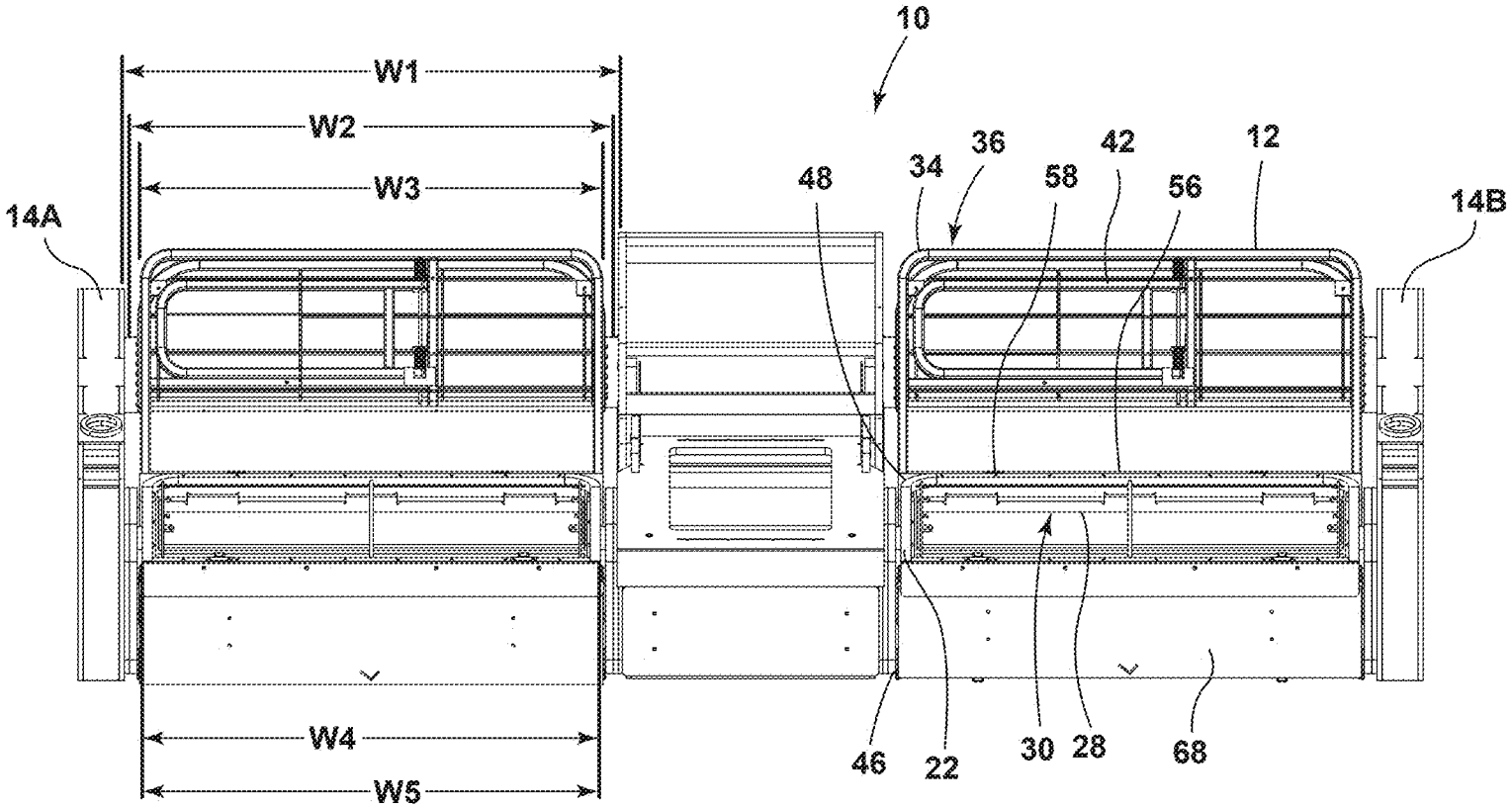
FIG. 2 is a front elevation view of the convertible furniture arrangement in the seating mode.

As best illustrated in FIG. 2, the support frame 16 has a first width W1 and the connection arrangement 44 has a second width W2, where W1 is greater than W2 such that the connection arrangement 44 can fit between the arm assemblies 14A, 14B and within the support frame 16 when in the retracted position 52. As further illustrated in FIG. 2, the support surface 34 has a third width W3 that is less than W2, while the link member 28 has a fourth width W4 that is less than W2 such that the link member 28 can fit within the connection member 44 when in the seated position, and specifically between the pair of connection members 50. The seat member 22 has a fifth width W5 that is less than W2 such that the seat member 22 can fit within the connection member 44 when the furniture arrangement 10 is in the seating configuration A, and specifically between the pair of connection members 50.

The furniture arrangement 10 may be converted from the seating configuration A (FIG. 1) to the bed configuration B (FIG. 3) by pivoting the link member 28 from being positioned over the support frame 16 to extending forwardly from the support frame 16 where the link member 28 is configured to support the user when in a prone position. Converting the furniture arrangement 10 to the bed configuration B includes pivoting the seat member 22 from the seating or first position (FIG. 1) to the bed or second position (FIG. 3), where the seat member 22 extends co-planarly and outwardly from the link member 28 when in the second position. The seat member may include a pair of legs 68 (FIG. 3) that support the seat member 22 when in the second position 26. In the illustrated example, the link member 28 pivots about 180 degrees between the first and second positions.

Converting the furniture arrangement 10 to the bed configuration B may include pivoting the support surface 34 between the back rest position (FIG. 1) where the support surface 34 extends substantially co-planarly with the back frame 12 and the seat member 22 when the seat member 22 is in the second position 26 and a pivoted position 38 where the support surface 34 is substantially horizontal and is located over the support frame 16 at a first height H1 and is configured to support the user in a prone position. When in the bed configuration B, the back frame 12 may resemble a headrest, such that the user may be prone on the furniture arrangement 10 in the bed configuration B with their head toward the back frame 12.

The furniture arrangement 10 may be converted to the table or dinette configuration C. In the table configuration C, the seat member 22 is in the first position similarly to the seating configuration A, and the link member 28 is positioned above the support frame 16, again similar to the seating configuration A. To convert the furniture arrangement 10 from the seating configuration A to the table configuration C, the connection arrangement 44 pivots away from the second side 20 of the support frame 16 along the first axis X between the retracted position and an extended position, where the second end 48 of the connection member 44 extends upwardly and is positioned above the first end 46 of the connection member. When in the table configuration C the support surface 34 is substantially horizontal located at a second height H2 that is greater than H1. The drop-down leg 42 may drop down and support the support surface 34 in the table position 40.

The furniture arrangement 10 is further configured to operate between the various configurations or modes when detached or uncoupled from the back frame 12 and the arm assemblies 14A, 14B. Specifically, the support frame 16 may be detached from the arm assemblies 14A, 14B via the pluralities of bolts 13, and the support frame 16, the seat member 22, the link member 28, the connection arrangement 44. The support arrangement 53 moves away from the back frame 12 and the arm assemblies 14A, 14B, where the furniture arrangement 10 may be converted between the various configurations including the seating configuration A, the bed configuration B and the table configuration C. The furniture arrangement 10 may also be configured to operate in a second table configuration when supported from the back frame 12 and the arm assemblies 14A, 14B where the support arrangement is configured similar to the bed configuration B and the support surface 34 is positioned vertically over the support frame 16 and is substantially horizontally oriented at the first height H1 thereby allowing the support surface 34 to utilize as a table surface.

In the foregoing description, it will be readily appreciated by those skilled in the art that modifications may be made to the embodiments as described and shown herein without departing from the concepts generally disclosed herein. Such modifications are to be considered as included in the following claims, unless these claims by their language expressly state otherwise.

The invention claimed is:

1. A convertible furniture arrangement, comprising:

a back frame;

a pair of arm assemblies fixedly secured to the back frame;

a support frame positioned forward of the back frame and between the pair of arm assemblies;

a seat member movable between a first position where the seat member is positioned over the support frame and configured to support a seated user thereon and a second position where the seat member is extended away from the support frame and configured to support the user that is in a prone position;

a link member operably coupled to the support frame and operably coupled to the seat member, where the link member is positioned vertically below the seat member when the seat member is in the first position and the link member is positioned horizontally between the support frame and the seat member and is configured to support the user that is in the prone position when the seat member is in the second position;

a support surface movable between a back rest position where the support surface is located proximate the back frame and substantially vertically oriented and a table position where the support surface is located forward of the seat member when the seat member is in the first position and where the support surface is substantially horizontally oriented to be utilized as a table surface; and a pair of L-shaped connection members each having a first end coupled to the support frame and a second end coupled to the support surface, where the connection members support the support surface between the back rest position and the table position.

2. The convertible furniture arrangement of claim 1, wherein the pair of L-shaped connection members are coupled to the support frame via a cross bar that extends between the pair of L-shaped connection members.

3. The convertible furniture arrangement of claim 2, wherein the pair of L-shaped connection members are pivotably coupled with the cross bar, and wherein the cross bar is pivotably coupled to the support frame.

4. The convertible furniture arrangement of claim 1, wherein the support frame includes a forwardly-located first side and a rearwardly-located second side opposite the first side, and wherein the link member and the pair of L-shaped connection members are both operably coupled to the first side of the support frame.

5. The convertible furniture arrangement of claim 1, wherein the link member is pivotably coupled with the support frame.

6. The convertible furniture arrangement of claim 1, wherein the L-shaped connection members are configured to be spaced between the pair of arm assemblies when the support surface is in the back rest position.

7. The convertible furniture arrangement of claim 1, wherein the second end of the each of the L-shaped connection members is pivotably coupled with the support surface.

8. The convertible furniture arrangement of claim 1, wherein the second end of each of the L-shaped connection members is coupled to a cross frame member that extends between the second ends of the L-shaped connection members.

9. The convertible furniture arrangement of claim 1, further comprising:

a support leg operably coupled with the support surface and configured to move between a retracted position where the support leg is proximate to and substantially parallel with the support surface and an extended position where the support leg extends away from and is substantially perpendicular with the support surface.

10. The convertible furniture arrangement of claim 9, wherein the support leg is spring biased from the extended position toward the retracted position.

11. The convertible furniture arrangement of claim 1, wherein the support surface is further configured to move to a pivoted position where the support surface is substantially planar with the seat member when the seat member is in the second position of the seat member and the support surface is configured to support the user in the prone position.

12. The convertible furniture arrangement of claim 1, wherein the convertible furniture arrangement comprises a sofa.

13. A convertible furniture arrangement, comprising:

a support frame;

a back frame coupled with the support frame;

at least one connection member pivotally coupled with the support frame at a first side of the support frame, wherein the connection member is configured to move between a retracted position proximate the base frame and an extended position in front of the base frame;

a support surface coupled with the at least one connection member, wherein the support surface is configured to move between a back rest position where the support surface is substantially vertically oriented and where the support surface is located between the back member and a user in a seated position, and a table position where the support surface is substantially horizontally oriented and is configured to be supported by the at least one connection member when the connection member is in the extended position;

a link member pivotally coupled with the support frame, wherein the link member is configured to move between a first position and a second position; and a seat member coupled with the link member, wherein the seat member is configured to move between a first position where the seat member is located above the link member and is configured to support the user in the seated position and a second position where the seat member is horizontally spaced from the support frame by the link member and is configured to support the user in a prone position.

14. The convertible furniture arrangement of claim 13, wherein the at least one connection member is L-shaped.

15. The convertible furniture arrangement of claim 13, wherein the at least one connection member includes a pair of connection members positioned at opposite ends of the support frame.

16. The convertible furniture arrangement of claim 15, wherein the pair of connection members are coupled to the support frame via a cross bar that extends between the pair of connection members.

17. The convertible furniture arrangement of claim 16, wherein the pair of connection members are pivotably coupled to the support frame via the cross bar.

18. The convertible furniture arrangement of claim 15, wherein the pair of connection members are configured to be spaced between a pair of arm assemblies fixed to the back frame when the support surface is in the back rest position.

19. The convertible furniture arrangement of claim 15, further comprising:

a support leg operably coupled with the support surface and configured to move between a retracted position where the support leg is located proximate to and is substantially parallel with the support surface and an extended position where the support leg extends away from and is substantially perpendicular with the support surface.

20. A furniture arrangement convertible between at least three configurations, the configurations comprising:

a seating configuration, comprising:

a support frame;

a back frame coupled to the support frame;

at least one connection member coupled to the support frame;

a support surface coupled with the at least one connection member, the support surface substantially parallel with the back frame;

a link member coupled with the support frame; and a seat member coupled with the link member, the link member and the seat member positioned above the support frame and configured to support a seated user;

a bed configuration, comprising:

the link member horizontally offset from the support frame and configured to support the user that is in a prone position;

the seat member horizontally spaced from the support frame by the link member and configured to support the user in the prone position; and the support surface substantially parallel with the seat member and configured to support the user in the prone position; and a first table configuration, comprising:

the seat member and the link member positioned above the support frame where the seat member is configured to support the seated user;

the at least one connection member extending forward of the seat member; and the support surface positioned forward of the seat member and substantially horizontally oriented and configured to be supported above a floor surface by the at least one connection member.

21. The furniture arrangement of claim 20, wherein the furniture arrangement may be converted between the seating configuration, the bed configuration and the first table configuration when the support frame is uncoupled from the back frame.

22. The furniture arrangement of claim 21, wherein the furniture arrangement is configured to be converted into a second table configuration where the seating member and the link member are positioned above the support frames and the support surface is positioned above the support frame and the seating member and is substantially horizontally oriented when the support frame is uncoupled from the back frame.

23. A convertible furniture arrangement, comprising:

a back frame;

a pair of arm assemblies fixedly secured to the back frame;

a support frame positioned forward of the back frame and between the pair of arm assemblies;

a seat member movable between a first position where the seat member is positioned over the support frame and configured to support a seated user thereon and a second position where the seat member is extended away from the support frame and configured to support the user that is in a prone position;

a link member pivotably coupled to the support frame and pivotably coupled to the seat member, where the link member is positioned vertically below the seat member when the seat member is in the first position and the link member is positioned horizontally between the support frame and the seat member and is configured to support the user that is in the prone position when the seat member is in the second position;

a support surface movable between a back rest position where the support surface is located proximate the back frame and substantially vertically oriented, a pivoted position where the support surface is substantially horizontal and planar with the seat member when the seat member is in the prone position, and a table position where the support surface is located forward of the seat member when the seat member is in the first position and where the support surface is substantially horizontally oriented to be utilized as a table surface;

a support leg operably coupled with the support surface and configured to move between a retracted position where the support leg is proximate to and substantially parallel with the support surface and an extended position where the support leg extends away from and is substantially perpendicular with the support surface; and a pair of L-shaped connection members each having a first end pivotably coupled to the support frame and a second end pivotably coupled to the support surface, where the connection members support the support surface between the back rest position and the table position.

24. The convertible furniture arrangement of claim 23, wherein the pair of L-shaped connection members are coupled to the support frame via a cross bar that extends between the pair of L-shaped connection members.

25. The convertible furniture arrangement of claim 23, wherein the support frame includes a forwardly-located first side and a rearwardly-located second side opposite the first side, and wherein the link member and the pair of L-shaped connection members are both operably coupled to the first side of the support frame.

* * * * *